US010801118B2

(12) United States Patent
Abbas

(10) Patent No.: US 10,801,118 B2
(45) Date of Patent: Oct. 13, 2020

(54) ELECTROLYSIS CELL, IN PARTICULAR FOR THE PRODUCTION OF ALUMINUM

(71) Applicant: TOKAI COBEX GMBH, Wiesbaden (DE)

(72) Inventor: Ghazanfar Abbas, Wiesbaden (DE)

(73) Assignee: TOKAI COBEX GMBH, Wiesbaden (DE)

( * ) Notice: Subject to any disclaimer, the term of this patent is extended or adjusted under 35 U.S.C. 154(b) by 0 days.

(21) Appl. No.: 14/394,317

(22) PCT Filed: Apr. 9, 2013

(86) PCT No.: PCT/EP2013/057366
§ 371 (c)(1),
(2) Date: Oct. 14, 2014

(87) PCT Pub. No.: WO2013/153053
PCT Pub. Date: Oct. 17, 2013

(65) Prior Publication Data

US 2015/0083584 A1 Mar. 26, 2015

(30) Foreign Application Priority Data

Apr. 12, 2012 (EP) ..... 12163944

(51) Int. Cl.
*C25C 3/08* (2006.01)

(52) U.S. Cl.
CPC ..... *C25C 3/08* (2013.01)

(58) Field of Classification Search
None
See application file for complete search history.

(56) References Cited

U.S. PATENT DOCUMENTS

| | | | | |
|---|---|---|---|---|
| 3,432,365 A | | 3/1969 | Katz et al. | |
| 3,444,276 A | * | 5/1969 | Olstowski | C04B 35/536 264/29.1 |
| 3,764,509 A | | 10/1973 | Etzel et al. | |
| 3,787,311 A | | 1/1974 | Wittner et al. | |
| 4,605,481 A | | 8/1986 | Langon | |

(Continued)

FOREIGN PATENT DOCUMENTS

| | | |
|---|---|---|
| CA | 2800855 A1 | 12/2011 |
| EP | 1233083 A1 | 8/2002 |
| WO | 8300325 A1 | 2/1983 |

OTHER PUBLICATIONS

Hale, Wayne, Improving the Useful Life of Aluminum Industry Cathodes, JOM, Nov. 1989, vol. 41, Issue 11. pp. 20-25.*

(Continued)

*Primary Examiner* — Harry D Wilkins, III
(74) *Attorney, Agent, or Firm* — Laurence A. Greenberg; Werner H. Stemer; Ralph E. Locher

(57) ABSTRACT

An electrolysis cell, particularly for the production of aluminum, contains a cathode, a layer of liquid aluminum arranged on the upper side of the cathode, a melt layer thereon and an anode on the top of the melt layer. The cathode is composed of at least two cathode blocks, wherein at least one of the at least two cathode blocks differs from at least one of the other cathode blocks with regard to the average compressive strength, the average thermal conductivity, the average specific electrical resistivity and/or the apparent density.

25 Claims, 7 Drawing Sheets

(56) References Cited

U.S. PATENT DOCUMENTS

| | | | | |
|---|---|---|---|---|
| 6,627,062 | B1 | 9/2003 | Dreyfus | |
| 2008/0156643 | A1 | 7/2008 | Dionne et al. | |
| 2010/0294635 | A1* | 11/2010 | Despinasse | C25C 3/16<br>204/230.2 |

OTHER PUBLICATIONS

Schnittker et al, Performance of Graphitized Carbon Cathode Blocks, TMS Light Metals, Mar. 2003, Proceedings of the technical sessions present by the TMS Aluminium Committee at the 132$^{nd}$ TMS Annual Meetings, pp. 641-645.*

Dumas et al, Low Electrical Resistivity and High Thermal Conductivity Carbon Products: The Solution for Cell Lining, Light Metals, 1983 (no month available), pp. 1189-1210 as reprinted in Essential Readings in Light Metals, Electrode Technology for Aluminum Production, edited by J. Johnson and A. Tomsett, 2016 (no month available), pp. 762-772.*

* cited by examiner

ELECTROLYSIS CELL, IN PARTICULAR FOR THE PRODUCTION OF ALUMINUM

BACKGROUND OF THE INVENTION

Field of the Invention:

The present invention relates to an electrolysis cell and in particular to an electrolysis cell for the production of aluminum.

Electrolysis cells are used, for example, for the electrolytic production of aluminum which is conventionally carried out at industrial scale according to the Hall-Heroult process. In the Hall-Heroult process, a mixture or melt composed of cryolite and aluminum oxide that is dissolved in the cryolite is electrolyzed. The cryolite, $Na_3[AlF_6]$, serves to reduce the liquidus temperature of the aluminum oxide, i.e. the temperature at which the aluminum oxide melts or is dissolved, from the melting point of 2,045° C. for pure aluminum oxide to 950° C. for a mixture of cryolite, aluminum oxide and calcium fluoride.

The electrolysis cell used in this process comprises a cathode bottom which is composed of multiple cathode blocks which are arranged adjacent to one another and form the cathode. In order to be able to withstand the thermal and chemical conditions which are present during the electrolysis process, the cathode is usually composed of a carbon-containing material. Slots are typically provided at the bottom sides of the cathode blocks, wherein at least one current collector bar is disposed in each of these slots for removing the current that is provided by the anodes. Furthermore, the electrolysis cell comprises at least one current feeder (which is subsequently also referred to as "riser") that extends at least partially in the vertical direction, that is electrically connected to the anode and that supplies electrical current to the anode. The anode which can be composed of multiple anode blocks is disposed about 3 to 5 cm above the aluminum layer that is disposed on the upper side of the cathode blocks and is typically 15 to 50 cm high. The electrolyte, i.e. the aluminum oxide and cryolite-containing melt layer, is arranged between the anode and the upper surface of the aluminum. The aluminum settles—due to its higher density compared to that of the electrolyte—below the electrolyte layer, i.e. as an interlayer between the upper side of the cathode blocks and the electrolyte layer, during the electrolysis operation that is carried out at around 1,000° C. At the same time, the aluminum oxide that is dissolved in the melt is separated by the action of electrical current flow into aluminum and oxygen, which then reacts with carbon of the anode to carbon dioxide. In an electrochemical sense, the layer of liquid aluminum represents the actual cathode, since aluminum ions are reduced to elementary aluminum on its upper surface. Nevertheless, the term cathode is hereinafter used to designate not the cathode in the electrochemical sense, i.e. the layer of liquid aluminum, but rather the component which forms the bottom of the electrolysis cell and which is composed of multiple cathode blocks.

The reliability, lifetime and energy efficiency of known electrolysis cells suffer from the adverse thermal and chemical conditions which are present in the electrolysis cell during the electrolysis operation. This leads to the requirement of frequent replacements of lining components of the cell or to the premature failure and shut-down of the entire electrolysis cell.

One of the main reasons for the reduced lifetime of known electrolysis cells is the wear of the upper surfaces of the cathode blocks during the electrolysis, i.e. the removal of cathode block material from the upper surfaces of the cathode blocks. This wear manifests itself in electrochemical corrosion and/or in mechanical abrasion of the cathode blocks. The mechanical abrasion is caused by turbulences in the layer of liquid aluminum. These turbulences are mainly caused by the Lorentz-force field in the layer of liquid aluminum which results from the current flowing through the layer of liquid aluminum and the electrical and magnetic fields induced therein. Furthermore, electrochemical corrosion is caused by the chemical reaction of the carbonaceous cathode block material with the liquid aluminum, which e.g. leads to the formation of aluminum carbide during the electrolysis.

Additionally, the process conditions of known electrolysis cells are not homogenous over the surface of the cathode during the electrolysis. On the contrary, during the electrolysis inhomogeneous wear conditions, i.e. electrochemically corrosive and/or mechanically abrasive conditions are present on the surface of the cathode leading to an inhomogeneous wear profile of the cathode. This means that the wear rate of the cathode material is higher in certain regions of the cathode surface compared to other regions, wherein the excessive wear in specific regions leads to the creation of localized weak spots in the cathode blocks. Such weak spots may lead to the migration of aluminum or electrolyte towards the current collector bars. This may result in an undesired reaction of the aluminum with the current collector bars, which can damage or destroy the electrical connection to the cathode and leads to the need to prematurely terminate the electrolysis process after a comparatively short time.

Moreover, the inhomogeneous processing conditions during the electrolysis lead to an inhomogeneous distribution of the electrical current density across the upper surface of the cathode. This inhomogeneous current distribution does not only contribute to the comparable short lifetime and bad reliability of known cathodes and cathode blocks, respectively, but is also a major reason for the bad energy efficiency of known cathodes and cathode blocks, respectively.

Furthermore, the inhomogeneous electrolysis process conditions in known electrolysis cells lead to an inhomogeneous heat generation in the cathode of the electrolysis cell and thus to an inhomogeneous temperature profile in the cathode. This inhomogeneous temperature profile is due to an excessive generation of heat occurring in certain areas of the cathode leading to an excessive thermal stress in these areas of the cathode, which reduces the lifetime of the cathode and thus the lifetime of the whole electrolysis cell.

The aforementioned effects are particularly significant in high amperage electrolysis cells.

As a further complication of the problem, the three above-identified phenomena in known electrolysis cells, namely the inhomogeneous wear profile, the inhomogeneous temperature profile and the inhomogeneous electrical current density across the cathode during the electrolysis, are interconnected. For example, an inhomogeneous electrical current density across the cathode surface contributes to an inhomogeneous generation of heat in the cathode as well as to an inhomogeneous mechanical abrasion and electrochemical corrosion of the cathode surface. In particular, the extent of turbulence in the layer of liquid aluminum which is, as described above, mainly responsible for the mechanical abrasion of the cathode surface, depends on the Lorentz-force field and hence strongly depends on the electrical current density in the respective region of the cathode surface.

Attempts have been already made to modify and particularly to homogenize the electrical current density across the cathode surface area, for example, by varying the specific electrical resistivity from ends to center of the cathode blocks. However, these attempts have not lead to completely satisfying results.

In particular, known attempts for increasing the lifetime and energy efficiency of an electrolysis cell have ignored the influence of the current feeders on the wear profile, temperature profile and electrical current density, in particular at those parts of the cathode which are located close to the current feeder. Namely, the high current densities flowing through the current feeders induce strong magnetic and electric fields in the regions of the cathode and the layer of liquid aluminum above the cathode surface which are close to the current feeder, which significantly impact the Lorentz-force field profile in the cathode and in the layer of liquid aluminum and hence have a dominant impact on the extent of turbulence in the layer of liquid aluminium and the resulting wear profile of the cathode surface. Likewise, the magnetic and electric field induced by the electrical current density significantly impacts the wear profile and temperature profile of the cathode. Since the geometries and relative arrangements of current feeders significantly vary for different electrolysis cell designs and implementations, a homogenization of the wear profile, the temperature profile and the electrical current density of the cathode is not possible without considering the specific electrolysis cell design.

BRIEF SUMMARY OF THE INVENTION

In view of the above, the object underlying the present invention is to provide an electrolysis cell, which is particularly suitable for high amperage operations, which has an increased energy efficiency, an improved lifetime, an increased stability as well as an improved reliability. Moreover, the electrolysis cell and in particular its cathode shall be manufacturable and installable easily, fast and cost-efficiently.

According to the present invention, this object is satisfied by providing an electrolysis cell, particularly for the production of aluminum, which comprises a cathode, a layer of liquid aluminum arranged on the upper side of the cathode, a melt layer thereon and an anode on the top of the melt layer, wherein the cathode is composed of at least two cathode blocks, wherein at least one of the at least two cathode blocks differs from at least one of the other cathode block(s) with regard to at least one of the average compressive strength, the average thermal conductivity, the average specific electrical resistivity and the apparent density.

According to the present invention, the cathode of the electrolysis cell comprises at least two cathode blocks, which differ from each other concerning at least one of the average compressive strength, the average thermal conductivity, the average specific electrical resistivity and the apparent density. This allows to at least partially homogenize the wear profile, which is formed during the electrolysis, across the surface of the cathode by homogenizing the rate of mechanical abrasion, the electrical current density and/or the temperature profile across the surface of the cathode by simply arranging different cathode blocks with appropriate properties together. For instance, in order to homogenize the wear profile across the surface of the cathode, cathode blocks having a higher average compressive strength may be arranged at those parts of the cathode at which during the electrolysis more wear occurs, whereas at the other parts of the cathode at which during the electrolysis less wear occurs, cathode blocks having a lower average compressive strength are arranged. For the same purpose, cathode blocks having a higher apparent density may be arranged at those parts of the cathode at which during the electrolysis more wear occurs, whereas at the other parts of the cathode at which during the electrolysis less wear occurs, cathode blocks having a lower apparent density are arranged. Likewise, the electrical current density, which is formed during the electrolysis of the electrolysis cell in the cathode, may be homogenized by suitably assembling the cathode of cathode blocks having a higher average specific electrical resistivity and of cathode blocks having a lower average specific electrical resistivity, and the temperature profile of the cathode, which is formed during the electrolysis of the electrolysis cell in the cathode, may be homogenized by suitably assembling the cathode of cathode blocks having a higher average thermal conductivity and of cathode blocks having a lower average thermal conductivity. Thus, the energy efficiency, the lifetime, the stability as well as the reliability of specifically the cathode and in general of the electrolysis cell are improved in a simple, fast and cost-efficient manner by means of a modular cathode block system. In particular, the cathode individually adapted to the electrolysis cell can be assembled from a limited number of pre-manufactured cathode blocks of different kinds at the time of the electrolysis cell installation, without requiring any a-priori customization of the cathode blocks. Instead, the present invention deliberately uses a simple and cost-efficient modular construction system.

The aforementioned effects are achieved, even if the at least two different cathode blocks differ from each other only in one of the average compressive strength, the average thermal conductivity, the average specific electrical resistivity and the apparent density. However, particularly good results are obtained, if the at least two different cathode blocks differ from each other in at least two, more preferably in at least three and most preferably in all four of the average compressive strength, the average thermal conductivity, the average specific electrical resistivity and the apparent density.

According to the present invention, each cathode block is homogenous concerning its composition and material properties, i.e. each cathode block has at every location the same composition and the same material properties. The term "same" has of course to be understood under consideration of the usual slight production tolerances, i.e. small variations concerning the composition and material properties are possible. To be more specific, according to the present invention a cathode block being homogenous concerning its compressive strength means that the variation of the compressive strength at different locations of the cathode block is less than 15%, preferably less than 12%, more preferably less than 8% and even more preferably less than 4%. Moreover, according to the present invention a cathode block is homogenous concerning its thermal conductivity if the variation of the thermal conductivity at different locations of the cathode block is less than 10%, preferably less than 8%, more preferably less than 5% and even more preferably less than 3%, a cathode block is homogenous concerning its specific electrical resistivity if the variation of the specific electrical resistivity at different locations of the cathode block is less than 12%, preferably less than 9%, more preferably less than 6% and even more preferably less than 4%, a cathode block is homogenous concerning its apparent density if the variation of the apparent density at different locations of the cathode block is less than 1.5%, preferably less than 1.2%, more preferably less than 0.8% and even more preferably less than 0.4% and a cathode block is homogenous concerning its open porosity if the variation of the open porosity at different locations of the cathode block is less than 10%, preferably less than 8%, more preferably less than 6% and even more preferably less than 4%. According to the present invention the term variation means the standard deviation of the average value of the respective parameter, wherein the average value is determined with 5 samples of the cathode block as described below.

Moreover, in the scope of the present invention the compressive strength of a cathode block is determined in accordance with the ISO18515. As set out above, each cathode block of the cathode of the electrolysis cell of the present invention is—under consideration of slight production tolerances—homogenous concerning its composition and material properties and thus homogenous concerning its compressive strength over all its dimensions, i.e. each cathode block has only minimal variations concerning its composition and material properties. In order to even consider these minimal variations as a result of production tolerances, herein the average compressive strength is specified, which is determined by measuring the compressive strength in accordance with the ISO18515 at 5 different locations of the cathode block, wherein the 5 different locations are uniformly distributed over the bottom surface of the cathode block, and by then calculating the arithmetic average of the 5 obtained values. More specifically, in order to determine the average compressive strength of a raw cathode block, i.e. a cathode block in which the slot or slots, respectively, are not already formed, 5 samples having a diameter of 3 cm and a length of 3 cm are taken from the area of the raw cathode block, in which afterwards the slot(s) are formed. In the case that one slot shall be formed in the bottom of the cathode block, the five samples are taken—in the direction of the length of the cathode block—in equal distances, i.e. e.g. in a cathode block having a length of 3 m five samples are taken with a distance between two adjacent samples and with a distance between the end of the cathode block and an adjacent sample of 0.5 m each,—in the direction of the width of the cathode block—in the middle of the slot to be subsequently formed and—in the direction of the height of the cathode block—in perpendicular direction. In the case that two slots shall be formed in the bottom of the cathode block, two samples are taken in the area where one of the slots shall be formed and three samples are taken in the area where the other slot shall be formed, wherein all of these samples fulfill the aforementioned criteria, i.e. they have a diameter of 3 cm and a length of 3 cm and they are taken—in the direction of the length of the cathode block—in equal distances,—in the direction of the width of the cathode block—in the middle of the slots to be subsequently formed and—in the direction of the height of the cathode block—in perpendicular direction. On the other hand, in order to determine the average compressive strength of a finished cathode block, i.e. a cathode block in which the slot or slots, respectively, are already formed, 5 samples having a diameter of 3 cm and a length of 3 cm are taken from the upper surface of the slot(s) in a direction perpendicular inside the cathode block, wherein the samples are taken—in the direction of the length of the cathode block—in equal distances and—in the direction of the width of the cathode block—in the middle of the slot(s).

Similarly, according to the present invention the average thermal conductivity of a cathode block is determined by measuring the thermal conductivity at a temperature of 30° C. in accordance with the ISO 12987 at 5 different locations of the cathode block, wherein the 5 different locations are arranged and uniformly distributed over the surface of the cathode block as set out above with regard to the determination of the average compressive strength, and by then calculating the arithmetic average of the 5 obtained values.

Likewise, in accordance with the present invention the average specific electrical resistivity of a cathode block is determined by measuring the specific electrical resistivity in accordance with the ISO 11713 at 5 different locations of the cathode block, wherein the 5 different locations are arranged and uniformly distributed over the surface of the cathode block as set out above with regard to the determination of the average compressive strength except that the length of the samples is 11 cm each, and by then calculating the arithmetic average of the 5 obtained values.

Moreover, according to the present invention the apparent density of a cathode block is measured in accordance with the ISO 12985-1 at 5 different locations of the cathode block, wherein the 5 different locations are arranged and uniformly distributed over the surface of the cathode block as set out above with regard to the determination of the average compressive strength except that the length of the samples is 11 cm each, and by then calculating the arithmetic average of the 5 obtained values.

According to a particular preferred embodiment of the present patent application, the electrolysis cell further comprises at least one current feeder, wherein the at least one current feeder extends at least partially in the vertical direction and is electrically connected to the anode, and wherein the at least one of the at least two cathode blocks differing from at least one of the other cathode block(s) is located closer to at least one of the at least one current feeder than the at least one of the other cathode block(s). In this particular preferred embodiment, the influence of the current feeders on the wear profile, the temperature profile and electrical current density of the cathode can be compensated. As set out above, the high electrical currents flowing through the current feeders induce strong magnetic and electric fields in the regions of the cathode and the layer of liquid aluminum above the cathode surface which are close to the current feeder, which significantly impact the Lorentz-force field profile in the cathode and in the layer of liquid aluminum and hence have a dominant impact on the extent of turbulence in the layer of liquid aluminium and the resulting wear profile of the cathode surface. Likewise, the magnetic and electric fields induced by the electrical current significantly impact the electrical current density and temperature profile of the cathode. Also in this embodiment it is preferred that the at least two different cathode blocks differ from each other in at least two, more preferably in at least three and most preferably in all four of the average compressive strength, the average thermal conductivity, the average specific electrical resistivity and the apparent density.

The present invention is not particularly limited concerning the number of cathode blocks per cathode. Typically, the cathode of the electrolysis cell will be composed of 2 to 60 cathode blocks. More preferably, the electrolysis cell comprises 5 to 40, particularly preferably 10 to 30, even more preferably 15 to 25 and most preferably about 20 cathode blocks.

According to a further preferred embodiment of the present invention, the cathode comprises 2 or more, preferably 2 to 10, more preferably 2 to 6 and even more preferably 2 to 4 different kinds of cathode blocks, wherein the cathode blocks of each kind differ from those of any other kind with regard to at least one, preferably at least two, more preferably in at least three and most preferably in all four of i) the average compressive strength by at least 25%, ii) the average thermal conductivity by at least 20%, iii) the average specific electrical resistivity by at least 20% and iv) the apparent density by at least 2%, whereas all of the cathode blocks of one kind differ from each other with regard to the average compressive strength by less than 15%, the average thermal conductivity by less than 10%, the average specific electrical resistivity by less than 12% and the apparent density by less than 1.5%, i.e. are identical or at least essentially identical with each other. From each of these different kinds of cathode blocks one or more cathode blocks may be provided in the cathode of the electrolysis cell. For example, the cathode may comprise one cathode block according to a first kind, two cathode blocks according to a second kind, four cathode blocks according to a third kind and thirteen cathode blocks according to a fourth kind. The number of different kinds of cathode blocks used in the cathode to a certain degree influences how fine the wear profile, temperature profile and/or electrical current density during the electrolysis is homogenized. However, it has been found in the present invention that a relatively moderate number of different kinds of cathode blocks, such as three or four different kinds of cathode blocks, is sufficient to effectively and sufficiently homogenize at least one of the wear profile, the temperature profile and the electrical current density over the entire surface of the cathode, in order to improve the reliability, lifetime and particularly the energy efficiency of the electrolysis cell. Preferably, the cathode blocks of each kind differ from those of any other kind with regard to at least one of the i) the average compressive strength by at least 35%, ii) the average thermal conductivity by at least 50%, iii) the average specific electrical resistivity by at least 30% and iv) the apparent density by at least 4%. More preferably, the cathode blocks of each kind differ from those of any other kind with regard to at least one of the i) the average compressive strength by at least 50%, ii) the average thermal conductivity by at least 100%, iii) the average specific electrical resistivity by at least 50% and iv) the apparent density by at least 6% and most preferably the cathode blocks of each kind differ from those of any other kind with regard to at least one of the i) the average compressive strength by at least 70%, ii) the average thermal conductivity by at least 200%, iii) the average specific electrical resistivity by at least 100% and iv) the apparent density by at least 8%.

According to a further preferred embodiment of the present invention, the cathode comprises three different kinds of cathode blocks, wherein the cathode blocks of each kind differ from those of the other two kinds with regard to at least one of i) the average compressive strength by at least 25%, preferably at least 35%, more preferably at least 50% and even more preferably at least 70%, ii) the average thermal conductivity by at least 20%, preferably at least 50%, more preferably at least 100% and even more preferably at least 200%, iii) the average specific electrical resistivity by at least 20%, preferably at least 30%, more preferably at least 50% and even more preferably at least 100% and iv) the apparent density by at least 2%, preferably at least 4%, more preferably at least 6% and even more preferably at least 8%. Furthermore, it is preferred that the cathode blocks of each kind are identical or at least essentially identical with each other, i.e. that they differ from each other with regard to the average compressive strength by less than 15%, preferably less than 12%, more preferably less than 8% and even more preferably less than 4%, with regard to the average thermal conductivity by less than 10%, preferably less than 8%, more preferably less than 5% and even more preferably less than 3%, with regard to the average specific electrical resistivity by less than 12%, preferably less than 9%, more preferably less than 6% and even more preferably less than 4% and with regard to the apparent density by less than 1.5%, preferably less than 1.2%, more preferably less than 0.8% and even more preferably less than 0.4%. This embodiment combines an effective homogenization of the respective wear profile, temperature profile and/or electrical current density during the electrolysis, while a minimal manufacturing and installation effort is necessary.

In order to particularly effectively compensate the influence of the at least one current feeder of the electrolysis cell on the inhomogeneity of at least one of the wear profile, the temperature profile and the electrical current density of the cathode, it is preferable that the electrolysis cell comprises at least one cathode block of a first kind which is located closest to one of the at least one current feeder and which is positioned between two cathode blocks of a second kind that differs from the first kind with regard to at least one of i) the average compressive strength by at least 25%, preferably at least 35%, more preferably at least 50% and even more preferably at least 70%, ii) the average thermal conductivity by at least 20%, preferably at least 50%, more preferably at least 100% and even more preferably at least 200%, iii) the average specific electrical resistivity by at least 20%, preferably at least 30%, more preferably at least 50% and even more preferably at least 100% and iv) the apparent density by at least 2%, preferably at least 4%, more preferably at least 6% and even more preferably at least 8%. The difference with regard to the average compressive strength, the average thermal conductivity, the average specific electrical resistivity and/or the apparent density is determined in this embodiment and in all other embodiments mentioned above and below based on the lowest of the respective values of the cathode blocks. Herein, two cathode blocks are referred to as being adjacent to each other, if they are arranged so that they directly contact each other or if they are connected with each other through a ramming paste, lining material or the like which is located between the two cathode blocks. In this embodiment, preferably each of the two cathode blocks of the second kind is arranged adjacent to a cathode block of a third kind, namely on the side of the cathode block of the second kind which is opposite to that which is adjacent to the cathode block of the first kind, wherein the third kind differs from the first and the second kind with regard to at least one of i) the average compressive strength by at least 25%, preferably at least 35%, more preferably at least 50% and even more preferably at least 70%, ii) the average thermal conductivity by at least 20%, preferably at least 50%, more preferably at least 100% and even more preferably at least 200%, iii) the average specific electrical resistivity by at least 20%, preferably at least 30%, more preferably at least 50% and even more preferably at least 100% and iv) the apparent density by at least 2%, preferably at least 4%, more preferably at least 6% and even more preferably at least 8%. Of course, as set out above, also the first and second kinds of cathode blocks differ from each other in at least one of the aforementioned properties by at least one of the aforementioned values. If the electrolysis cell comprises two, three or even more risers, it is preferable that the electrolysis cell comprises two, three or even more cathode blocks of the first kind, wherein each of this is located closest to one of the current feeders and is positioned between two cathode blocks of the second kind, which again are preferably adjacent to a cathode block of a third kind. The cathode blocks of each kind are identical or at least essentially identical with each other, i.e. that they differ from each other with regard to the average compressive strength by less than 15%, preferably less than 12%, more preferably less than 8% and even more preferably less than 4%, with regard to the average thermal conductivity by less than 10%, preferably less than 8%, more preferably less than 5% and even more preferably less than 3%, with regard to the average specific electrical resistivity by less than 12%, preferably less than 9%, more preferably less than 6% and even more preferably less than 4% and with regard to the apparent density by less than 1.5%, preferably less than 1.2%, more preferably less than 0.8% and even more preferably less than 0.4%.

In the aforementioned embodiment, each of the aforementioned cathode blocks of the third kind may be adjacent on its other side, i.e. on the side of the cathode block of the third kind that is opposite to that which is adjacent to the cathode block of the second kind, to a cathode block of a fourth kind, wherein the fourth kind differs from the first, second and the third kind with regard to at least one of i) the average compressive strength by at least 25%, preferably at least 35%, more preferably at least 50% and even more preferably at least 70%, ii) the average thermal conductivity by at least 20%, preferably at least 50%, more preferably at least 100% and even more preferably at least 200%, iii) the average specific electrical resistivity by at least 20%, preferably at least 30%, more preferably at least 50% and even more preferably at least 100% and iv) the apparent density by at least 2%, preferably at least 4%, more preferably at least 6% and even more preferably at least 8%. Of course, as set out above, also the first, second and third kinds of cathode blocks differ from each other in at least one of the aforementioned properties by at least one of the aforementioned values. This means, each of the kinds of cathode blocks differs from each other kind of the cathode blocks in at least one of the aforementioned properties by at least one of the aforementioned values.

According to an alternative embodiment of the present invention, the electrolysis cell comprises at least one cathode block of a first kind that is located closest to at least one of the current feeders and that is, on one of its sides, arranged adjacent to a cathode block of a second kind which differs from the first kind with regard to at least one of i) the average compressive strength by at least 25%, preferably at least 35%, more preferably at least 50% and even more preferably at least 70%, ii) the average thermal conductivity by at least 20%, preferably at least 50%, more preferably at least 100% and even more preferably at least 200%, iii) the average specific electrical resistivity by at least 20%, preferably at least 30%, more preferably at least 50% and even more preferably at least 100% and iv) the apparent density by at least 2%, preferably at least 4%, more preferably at least 6% and even more preferably at least 8%, and that is, on its other side, arranged adjacent to a cathode block of a third kind which differs from the first and the second kind with regard to at least one of i) the average compressive strength by at least 25%, preferably at least 35%, more preferably at least 50% and even more preferably at least 70%, ii) the average thermal conductivity by at least 20%, preferably at least 50%, more preferably at least 100% and even more preferably at least 200%, iii) the average specific electrical resistivity by at least 20%, preferably at least 30%, more preferably at least 50% and even more preferably at least 100% and iv) the apparent density by at least 2%, preferably at least 4%, more preferably at least 6% and even more preferably at least 8%. In this case, the cathode block of the second kind may be connected on its side opposite to that adjacent to the cathode block of the first kind to a cathode block of a fourth kind which differs from the first, second and third kind with regard to at least one of i) the average compressive strength by at least 25%, preferably at least 35%, more preferably at least 50% and even more preferably at least 70%, ii) the average thermal conductivity by at least 20%, preferably at least 50%, more preferably at least 100% and even more preferably at least 200%, iii) the average specific electrical resistivity by at least 20%, preferably at least 30%, more preferably at least 50% and even more preferably at least 100% and iv) the apparent density by at least 2%, preferably at least 4%, more preferably at least 6% and even more preferably at least 8%. Likewise, the cathode block of the third kind may be arranged on its side opposite to that adjacent to the cathode block of the first kind to a cathode block which may be of the fourth kind or, alternatively, of a fifth kind which differs from the first to fourth kind with regard to at least one of i) the average compressive strength by at least 25%, preferably at least 35%, more preferably at least 50% and even more preferably at least 70%, ii) the average thermal conductivity by at least 20%, preferably at least 50%, more preferably at least 100% and even more preferably at least 200%, iii) the average specific electrical resistivity by at least 20%, preferably at least 30%, more preferably at least 50% and even more preferably at least 100% and iv) the apparent density by at least 2%, preferably at least 4%, more preferably at least 6% and even more preferably at least 8%. As set out above, each of the kinds of cathode blocks differs from each other kind of the cathode blocks in at least one of the aforementioned properties by at least one of the aforementioned values.

According to a further preferred embodiment of the present invention, the electrolysis cell comprises at least two cathode blocks of a first kind which are arranged adjacent to each other, at least one of which is located closest to at least one of the at least one current feeder, and which are each arranged adjacent to a cathode block of a second kind that is different from the first kind with regard to at least one of i) the average compressive strength by at least 25%, preferably at least 35%, more preferably at least 50% and even more preferably at least 70%, ii) the average thermal conductivity by at least 20%, preferably at least 50%, more preferably at least 100% and even more preferably at least 200%, iii) the average specific electrical resistivity by at least 20%, preferably at least 30%, more preferably at least 50% and even more preferably at least 100% and iv) the apparent density by at least 2%, preferably at least 4%, more preferably at least 6% and even more preferably at least 8%. In this embodiment, preferably each of the at least two cathode blocks of the second kind is arranged adjacent to a cathode block of a third kind, wherein the third kind differs from the first and the second kind with regard to at least one of i) the average compressive strength by at least 25%, preferably at least 35%, more preferably at least 50% and even more preferably at least 70%, ii) the average thermal conductivity by at least 20%, preferably at least 50%, more preferably at least 100% and even more preferably at least 200%, iii) the average specific electrical resistivity by at least 20%, preferably at least 30%, more preferably at least 50% and even more preferably at least 100% and iv) the apparent density by at least 2%, preferably at least 4%, more preferably at least 6% and even more preferably at least 8%. As set out above, each of the kinds of cathode blocks differs from each other kind of the cathode blocks in at least one of the aforementioned properties by at least one of the aforementioned values. Again, the cathode blocks of each kind are identical or at least essentially identical with each other, i.e. that they differ from each other with regard to the average compressive strength by less than 15%, preferably less than 12%, more preferably less than 8% and even more preferably less than 4%, with regard to the average thermal conductivity by less than 10%, preferably less than 8%, more preferably less than 5% and even more preferably less than 3%, with regard to the average specific electrical resistivity by less than 12%, preferably less than 9%, more preferably less than 6% and even more preferably less than 4% and with regard to the apparent density by less than 1.5%, preferably less than 1.2%, more preferably less than 0.8% and even more preferably less than 0.4%.

In an alternative embodiment of the present invention, the electrolysis cell comprises at least two cathode blocks of a first kind which are arranged adjacent to each other and at least one of which is located closest to at least one of the at least one current feeder, wherein one of the cathode blocks of the first kind is, at its side opposite to that adjacent to the other cathode block of the first kind, arranged adjacent to a cathode block of a second kind, whereas the other of the at least two cathode blocks is, at its side opposite to that adjacent to the other cathode block of the first kind arranged adjacent to a cathode block of a third kind, wherein all of the first, second and third kind differ from each other with regard to at least one of i) the average compressive strength by at least 25%, preferably at least 35%, more preferably at least 50% and even more preferably at least 70%, ii) the average thermal conductivity by at least 20%, preferably at least 50%, more preferably at least 100% and even more preferably at least 200%, iii) the average specific electrical resistivity by at least 20%, preferably at least 30%, more preferably at least 50% and even more preferably at least 100% and iv) the apparent density by at least 2%, preferably at least 4%, more preferably at least 6% and even more preferably at least 8%. In this embodiment, the cathode block of the second kind may, at its side opposite to that adjacent to the cathode block of the first kind, be adjacent to a cathode block of a fourth kind and the cathode block of the third kind may, at its side opposite to that adjacent to the other cathode block of the first kind, be adjacent to a cathode block either of the fourth kind or of a fifth kind, wherein all of the first to fifth kind differ from each other with regard at least one of i) the average compressive strength by at least 25%, preferably at least 35%, more preferably at least 50% and even more preferably at least 70%, ii) the average thermal conductivity by at least 20%, preferably at least 50%, more preferably at least 100% and even more preferably at least 200%, iii) the average specific electrical resistivity by at least 20%, preferably at least 30%, more preferably at least 50% and even more preferably at least 100% and iv) the apparent density by at least 2%, preferably at least 4%, more preferably at least 6% and even more preferably at least 8%. Also in this embodiment, the cathode blocks of each kind are identical or at least essentially identical with each other, i.e. that they differ from each other with regard to the average compressive strength by less than 15%, preferably less than 12%, more preferably less than 8% and even more preferably less than 4%, with regard to the average thermal conductivity by less than 10%, preferably less than 8%, more preferably less than 5% and even more preferably less than 3%, with regard to the average specific electrical resistivity by less than 12%, preferably less than 9%, more preferably less than 6% and even more preferably less than 4% and with regard to the apparent density by less than 1.5%, preferably less than 1.2%, more preferably less than 0.8% and even more preferably less than 0.4%.

According to a first particularly preferred embodiment of the present invention, at least one and preferably each of the cathode blocks of the cathode has an average compressive strength between 15 and 70 MPa, preferably between 20 and 60 MPa and more preferably between 25 and 55 MPa. The compressive strength of a cathode block is directly correlated with the hydro-abrasive wear, which appears, whenever a solids-containing moving fluid is present in a system. Thus, the higher the average compressive strength of a cathode block, the lower the mechanical abrasion of the cathode block during the electrolysis.

Particularly good results concerning the homogenization of the wear profile across the entire cathode of the electrolysis cell are obtained in this embodiment, when the difference between the average compressive strength of the at least one cathode block differing from at least one of the other cathode block(s) and the average compressive strength of the at least one of the other cathode block(s) is at least 25%, preferably at least 35%, more preferably at least 50% and even more preferably at least 70% of the lowest of these average compressive strengths.

In the aforementioned embodiment, it is particularly preferable that the at least one of the at least two cathode blocks differing from at least one of the other cathode block(s) is located closer to at least one of the at least one current feeder than the at least one of the other cathode block(s). Generally, the cathode block that is located closer to the at least one current feeder may either have a higher average compressive strength or a lower average compressive strength than the other one of the at least two cathode blocks. Whether a cathode block with a higher or lower average compressive strength close to the at least one current feeder is more advantageous depends on the thermal management of the complete electrolysis cell. For example, the ideal positioning of the cathode blocks with the higher average compressive strength and those with the lower average compressive strength relative to the at least one current feeder depends on whether the electrolysis cell design relies primarily on a removal of heat from the cathode via the bottom of the electrolysis cell cathode or on the removal of heat via the sidewalls encompassing the electrolysis cell cathode.

In the aforementioned embodiment it is preferred that the cathode comprises at least 3 different kinds of cathode blocks, wherein the average compressive strengths of all cathode blocks of one kind differ from each other by less than 15%, preferably less than 12%, more preferably less than 8% and even more preferably less than 4% and the average compressive strengths of all cathode blocks of one kind differ from the average compressive strengths of all cathode blocks of all other kinds by at least 25%, preferably at least 35%, more preferably at least 50% and even more preferably at least 70% of the lowest of these average compressive strengths.

In accordance with a second particularly preferred embodiment of the present invention it is proposed that at least one and preferably each of the cathode blocks has a thermal conductivity between 10 and 170 W/m·K and, in particular between 30 and 130 W/m·K, especially when the cathode comprises both graphitic and graphitized cathode blocks, or between 70 and 130 W/m·K, especially when the cathode comprises only graphitized cathode blocks.

Particularly good results concerning the homogenization of the temperature profile during the electrolysis across the entire cathode of the electrolysis cell are obtained in this embodiment, when the difference between the average thermal conductivity of the at least one cathode block differing from at least one of the other cathode block(s) and the average thermal conductivity of the at least one of the other cathode block(s) is at least 20%, preferably at least 50%, more preferably at least 100% and even more preferably at least 200% of the lowest of these thermal conductivities.

Also in this embodiment it is preferred that the at least one of the at least two cathode blocks differing from at least one of the other cathode block(s) is located closer to at least one of the at least one current feeder than the at least one of the other cathode block(s). Generally, the cathode block that is located closer to the at least one current feeder may either have a higher thermal conductivity or a lower thermal conductivity than the other one of the at least two cathode blocks. Whether a cathode block with a higher or lower thermal conductivity close to the at least one current feeder is more advantageous depends on the thermal management of the complete electrolysis cell. For example, the ideal positioning of the cathode blocks with the higher thermal conductivity and those with the lower thermal conductivity relative to the at least one current feeder depends on whether the electrolysis cell design relies primarily on a removal of heat from the cathode via the bottom of the electrolysis cell cathode or on the removal of heat via the sidewalls encompassing the electrolysis cell cathode.

In the aforementioned embodiment it is preferred that the cathode comprises at least 3 different kinds of cathode blocks, wherein the average thermal conductivities of all cathode blocks of one kind are differ from each other by less than 10%, preferably less than 8%, more preferably less than 5% and even more preferably less than 3%.

According to a third particularly preferred embodiment of the present invention, at least one and preferably each of the cathode blocks has an average specific electrical resistivity between 7 and 40 Ohm μm and preferably between 8.5 and 21 Ohm·μm, in particular when the cathode comprises both graphitic and graphitized cathode blocks, or between 8.5 and 14 Ohm·μm, in particular when the cathode comprises only graphitized cathode blocks.

Particularly good results concerning the homogenization of the electrical current density during the electrolysis across the entire cathode surface of the electrolysis cell are obtained in this embodiment, when the difference between the average specific electrical resistivity of the at least one cathode block differing from at least one of the other cathode block(s) and the average specific electrical resistivity of the at least one of the other cathode block(s) is at least 20%, preferably at least 30%, more preferably at least 50% and even more preferably at least 100% of the lowest of these average specific electrical resistivities.

Preferably, the at least one of the at least two cathode blocks differing from at least one of the other cathode block(s) is located closer to at least one of the at least one current feeder than the at least one of the other cathode block(s). Generally, the cathode block closer to the current feeder may either exhibit the higher or the lower of the two average specific electrical resistivities; which of these arrangements is preferred depends on the current management of the electrolysis cell.

In the aforementioned embodiment it is preferred that the cathode comprises at least 3 different kinds of cathode blocks, wherein the average specific electrical resistivities of all cathode blocks of one kind differ from each other by less than 12%, preferably less than 9%, more preferably less than 6% and even more preferably less than 4% of the lowest of these average specific electrical resistivities.

According to a fourth particularly preferred embodiment of the present invention, at least one and preferably each of the cathode blocks has an apparent density between 1.50 and 1.90 g/cm$^3$, preferably between 1.55 and 1.85 g/cm$^3$ and more preferably between 1.60 and 1.80 g/cm$^3$.

Particularly good results concerning the homogenization of the wear profile during the electrolysis across the entire cathode surface of the electrolysis cell are obtained in this embodiment, when the difference between the apparent density of the at least one cathode block differing from at least one of the other cathode block(s) and the apparent density of the at least one of the other cathode block(s) is at least 2%, preferably at least 4%, more preferably at least 6% and even more preferably at least 8% of the lowest of these apparent densities.

Also in this embodiment, it is preferred that the at least one of the at least two cathode blocks differing from at least one of the other cathode block(s) is located closer to at least one of the at least one current feeder than the at least one of the other cathode block(s).

Preferably, the cathode comprises at least 3 different kinds of cathode blocks, wherein the apparent densities of all cathode blocks of one kind differ from each other by less than 1.5%, preferably less than 1.2%, more preferably less than 0.8% and even more preferably less than 0.4% and the apparent densities of all cathode blocks of one kind differ from the apparent densities of all cathode blocks of all other kinds by at least 2%, preferably at least 4%, more preferably at least 6% and even more preferably at least 8% of the lowest of these apparent densities.

As the apparent density is influenced by the open porosity of a cathode block, it is preferred that in the aforementioned embodiment the at least one cathode block having a higher apparent density has a lower average open porosity than the at least one other cathode block having a lower apparent density. Herein, the open porosity of the cathode block material is determined in accordance with the ISO-standard ISO 12985-2 and the average open porosity of a cathode block is determined by measuring the open porosity in accordance with the ISO-standard ISO 12985-2 at 5 different locations of the cathode block as specified above with regard to the determination of the apparent density, and by then calculating the arithmetic average of the 5 obtained values.

In this embodiment, the difference between the average open porosity of the at least one cathode block differing from at least one of the other cathode block(s) and the average open porosity of the at least one of the other cathode block(s) may be for example at least 15%, preferably at least 20%, more preferably at least 30% and even more preferably at least 40% of the lowest of these average open porosities. Also in this embodiment, the at least one of the at least two cathode blocks differing from at least one of the other cathode block(s) is located closer to at least one of the at least one current feeder than the at least one of the other cathode block(s). In this embodiment, the difference between the average open porosity of the at least one cathode block that is located closer to at least one of the at least one current feeder and the average open porosity of the at least one other cathode block that is arranged more distant from the at least one current feeder may be for example at least 15%, preferably at least 20%, more preferably at least 30% and even more preferably at least 40% of the lowest of these average open porosities.

In principal, the cathode blocks of the electrolysis cell according to the present invention may be composed of every material known to a person skilled in the art. The present invention is particularly applicable to carbon-based cathodes. Accordingly, it is preferred that at least one of the and more preferably all of the cathode blocks comprise(s) or even consist(s) of a carbon-based material and, in particular one of a graphitic carbon, a graphitized carbon or an amorphous carbon. These materials are particularly suitable for electrolysis cells which are to be used for the production of aluminum, such as by the Hall-Heroult process. The shape and dimensions of the cathode blocks may be exactly the same as the cathode blocks used in electrolysis cells of the prior art. Thus, at least one and preferably each of the cathode blocks may have a substantially rectangular base shape with two longitudinal sides defining the length of the respective cathode block and two broad sides defining the width of the respective cathode block, wherein the single cathode blocks are preferably arranged adjacent to one another along their longitudinal sides.

BRIEF DESCRIPTION OF THE SEVERAL VIEWS OF THE DRAWING

The invention will now be described by means of preferred embodiments with reference to the accompanying drawings, in which.

DESCRIPTION OF THE INVENTION

Figure 1:
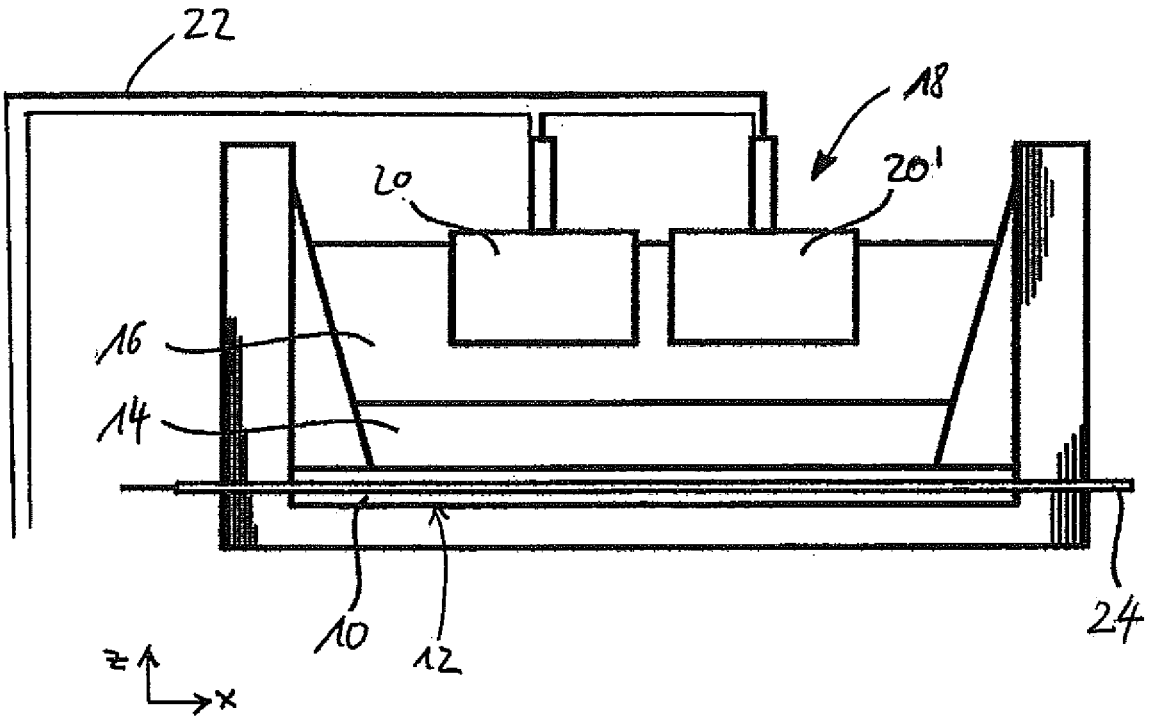
FIG. 1 shows a schematic side view of an electrolysis cell.

FIG. 1 shows a side view of an electrolysis cell, which comprises several cathode blocks 10 forming the cathode 12 of the electrolysis cell. As shown in FIG. 1, the length of one cathode block 10 essentially covers the entire width of the electrolysis cell, whereas in the longitudinal direction y (cf. FIGS. 2 to 13) of the electrolysis cell, i.e. in the direction perpendicular to the drawing plane in FIG. 1, several cathode blocks 10 are arranged adjacent to each other and are connected to each other along their broad sides to cover the length of the electrolysis cell. A layer 14 of liquid aluminum is disposed on top of the cathode 12 and a melt layer 16 is arranged on the layer 14 of liquid aluminum. Finally, an anode 18 composed of multiple anode blocks 20, 20' is arranged above the melt layer 16 and contacts the upper surface of the melt layer 16. Furthermore, the anode blocks 20, 20' are in electrical contact with one of one or more current feeders 22 which at least partially extends in the vertical direction and which supplies current to the electrolysis cell. As shown in FIG. 1, the two anode blocks 20, 20' substantially cover the length of one cathode block 10 in the cross-direction x of the electrolysis cell. Electrical current is provided by the current feeder 22 and enters the electrolysis cell via the anode blocks 20, 20', passes through the melt layer 16 and the layer 14 of liquid aluminum and then enters the cathode block 10, from which the electrical current is collected by a current collector bar 24 extending through the lower part of the cathode block 10. The electrolysis cell components are not drawn to scale in FIG. 1. Rather, in reality the height of the cathode block 10 is higher relative to the height of the layer 14 of liquid aluminum and the melt layer 16. Furthermore, the current collector bar 24 is usually inserted in a slot which is arranged in the bottom part of the cathode 12 rather than being arranged in the middle of the cathode 12 as it is schematically shown in FIG. 1.

Figure 2:
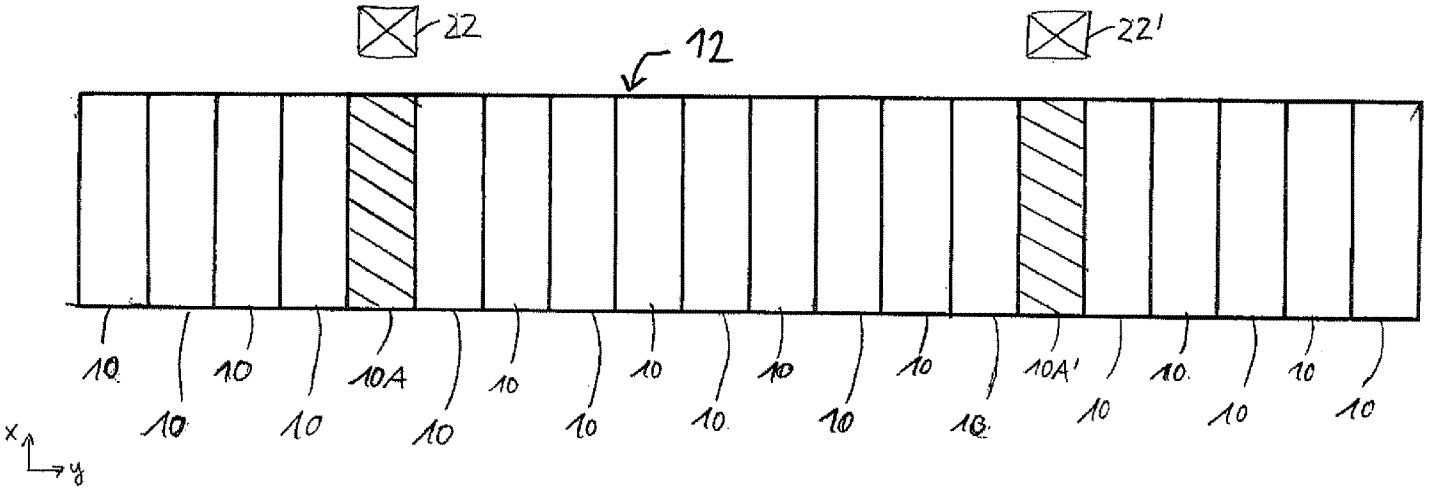
FIGS. 2 to 13 show a schematic top view of a cathode of an electrolysis cell according to a respective embodiment of the present invention.

FIG. 2 shows a schematic top view of a cathode 12 of an electrolysis cell according to a first exemplary embodiment of the present invention.

The electrolysis cell cathode 12 consists of 20 cathode blocks 10, 10A, 10A' which are arranged adjacent to one another in the longitudinal direction y of the electrolysis cell to form a rectangular base shape of the electrolysis cell. Also shown are two current feeders 22, 22' which are arranged on one side of the cathode 12 and which are electrically connected to the anode (not shown in FIG. 2) of the electrolysis cell. Generally, according to the invention, the electrolysis cell may comprise one current feeder or more than one current feeder, e.g. 2, 3, 4 or more current feeders. Likewise, the number of cathode blocks may vary and an electrolysis cell may in particular comprise more than 20, e.g. 30 or more cathode blocks.

The cathode block 10A which is closest to the current feeder 22 is of a first kind (hereinafter also referred to as "kind A") which is different from the kind of the cathode blocks 10 adjacent to the cathode block 10A with regard to at least one of the wear resistance, the thermal conductivity and the specific electrical resistivity. Likewise, the cathode block 10A' which is located closest to the current feeder 22' is of kind A which is different from the kind of the cathode blocks 10 adjacent to cathode block 10A' with regard to at least one of the average compressive strength, the average thermal conductivity, the average specific electrical resistivity and the apparent density.

In this manner, the wear profile, the temperature profile and/or the electrical current density of the electrolysis cell can be effectively homogenized with minimum implementation effort.

All cathode blocks 10 shown in FIG. 2 are composed of identical materials and thus, in particular all have the same the average compressive strength, the same average thermal conductivity, the same average specific electrical resistivity and the same apparent density.

Figure 3:
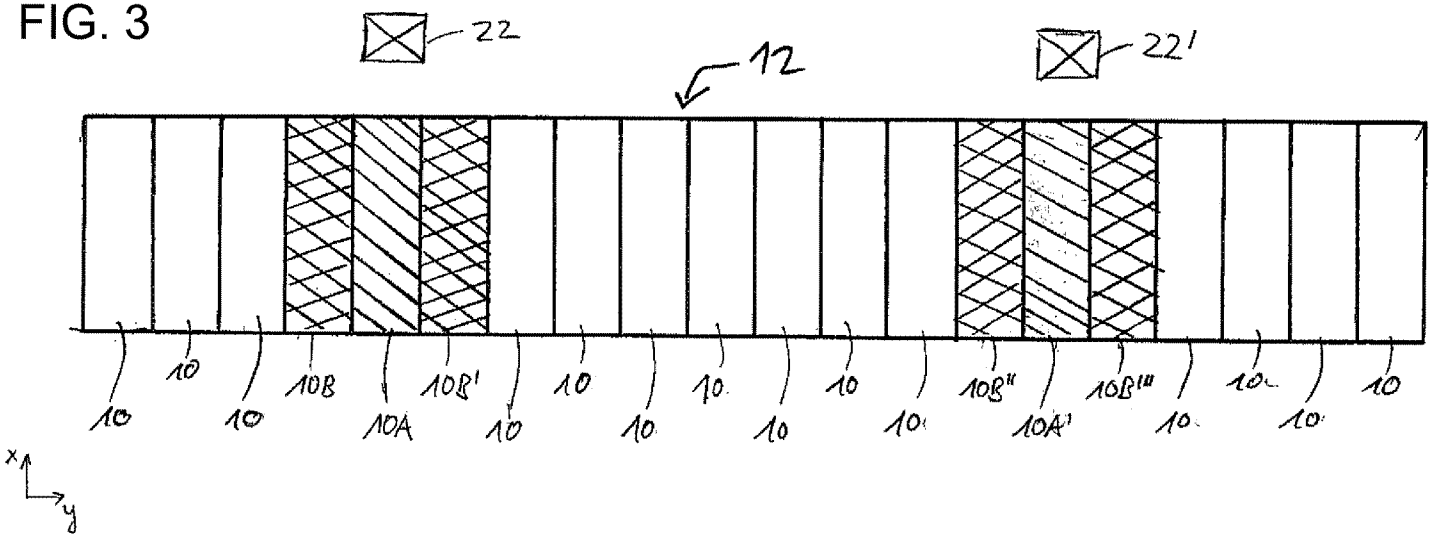

FIG. 3 shows a second exemplary embodiment of the present invention which is similar to the above-described first embodiment, wherein each current feeder 22, 22' is assigned to a cathode block 10A, 10A' of a first kind A, each of which being positioned between two cathode blocks 10B, 10B' and 10B", 10B'", respectively, wherein the cathode blocks 10B, 10B' and 10B", 10B'" are of a second kind B that is different from kind A with regard to at least one of the average compressive strength, the average thermal conductivity, the average specific electrical resistivity and the apparent density. All of the remaining cathode blocks 10 are of a third kind which is different from kind A as well as from kind B with regard to at least one of the average compressive strength, the average thermal conductivity, the average specific electrical resistivity and the apparent density.

Figure 4:
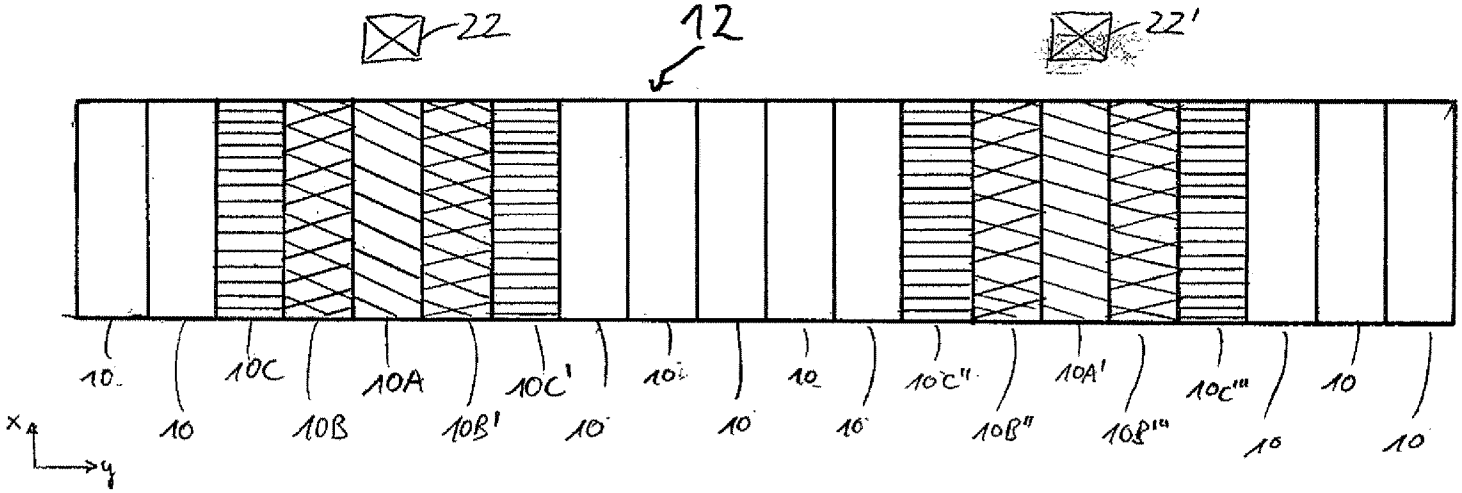

FIG. 4 shows a third exemplary embodiment of a cathode 12 of the electrolysis cell of the present invention which is similar to the second exemplary embodiment shown in FIG. 3, but differs from that in that a fourth kind of cathode blocks 100, 10C', 100", 10C'" is provided, wherein each cathode block 100, 10C', 100", 10C'" of the fourth kind is arranged between one of cathode blocks 10B, 10B', 10B", 10B'" and a cathode block 10, wherein the fourth kind differs from the other three kinds with regard to at least one of the average compressive strength, the average thermal conductivity, the average specific electrical resistivity and the apparent density.

Figure 5:
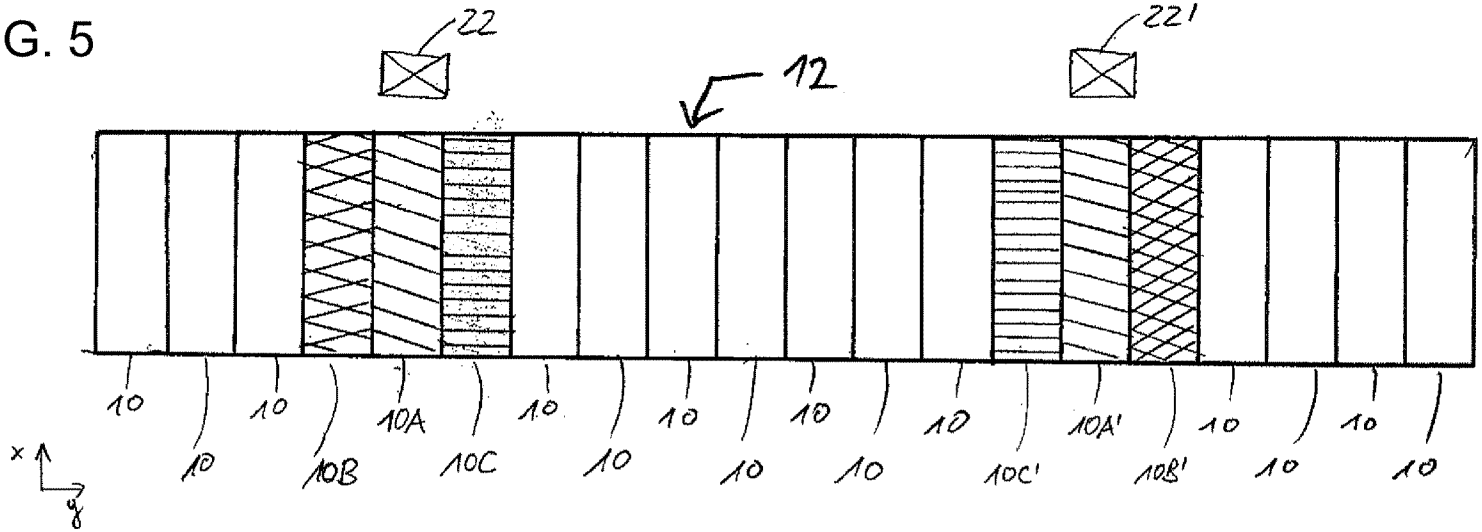

FIG. 5 shows a fourth exemplary embodiment of a cathode 12 of the electrolysis cell of the present invention which is similar to the first exemplary embodiment shown in FIG. 2, but differs from that in that a third kind of cathode blocks 10B, 10B' and a fourth kind of cathode blocks 10C, 10C' are provided, wherein one of each of the cathode blocks 10B, 10B', 10C, 10C' of the second and third kind is adjacent to a cathode block 10A of kind A. Also in this embodiment all kinds are different from each other with regard to at least one of the average compressive strength, the average thermal conductivity, the average specific electrical resistivity and the apparent density.

Figure 6:
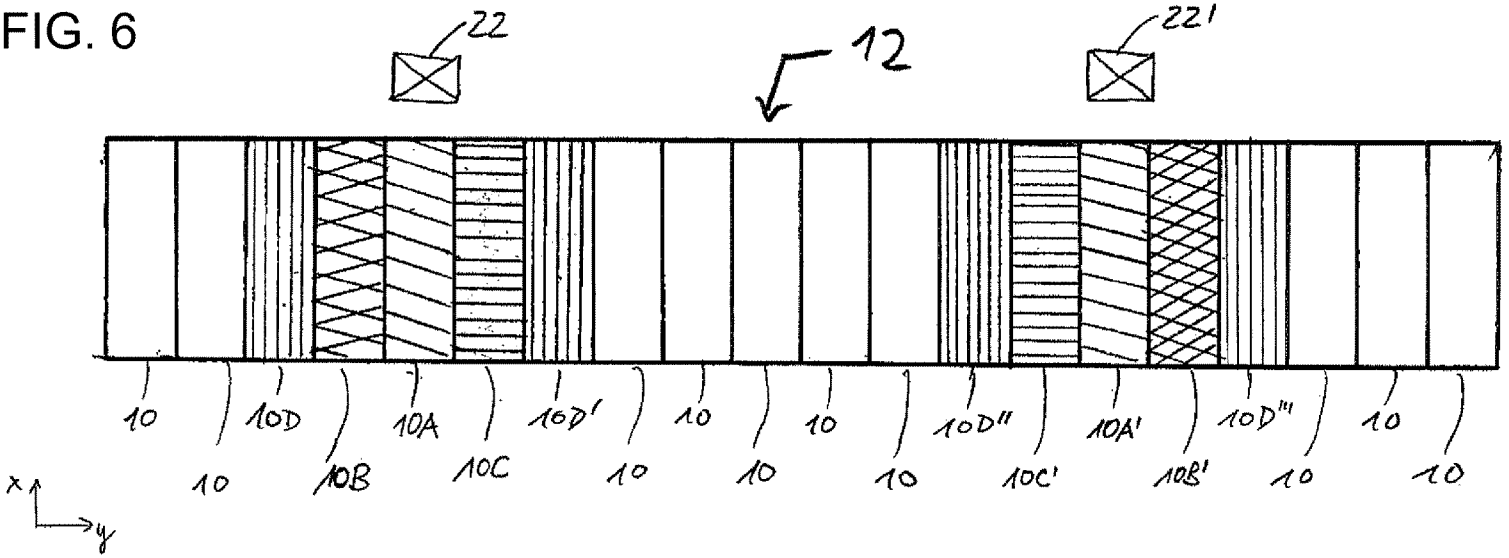

FIG. 6 shows a fifth exemplary embodiment of a cathode 12 of the electrolysis cell of the present invention which is similar to the fourth exemplary embodiment shown in FIG. 5, but differs from that in that a fifth kind of cathode blocks 10D, 10D', 10D", 10D'" is provided, wherein each cathode block 10D, 10D', 10D", 10D'" of the fifth kind is arranged between cathode blocks 10B and 10, between cathode blocks 10C and 10, between cathode blocks 10C' and 10 and between cathode blocks 10B' and 10, respectively, wherein all kinds are different from each other with regard to at least one of the average compressive strength, the average thermal conductivity, the average specific electrical resistivity and the apparent density.

Figure 7:
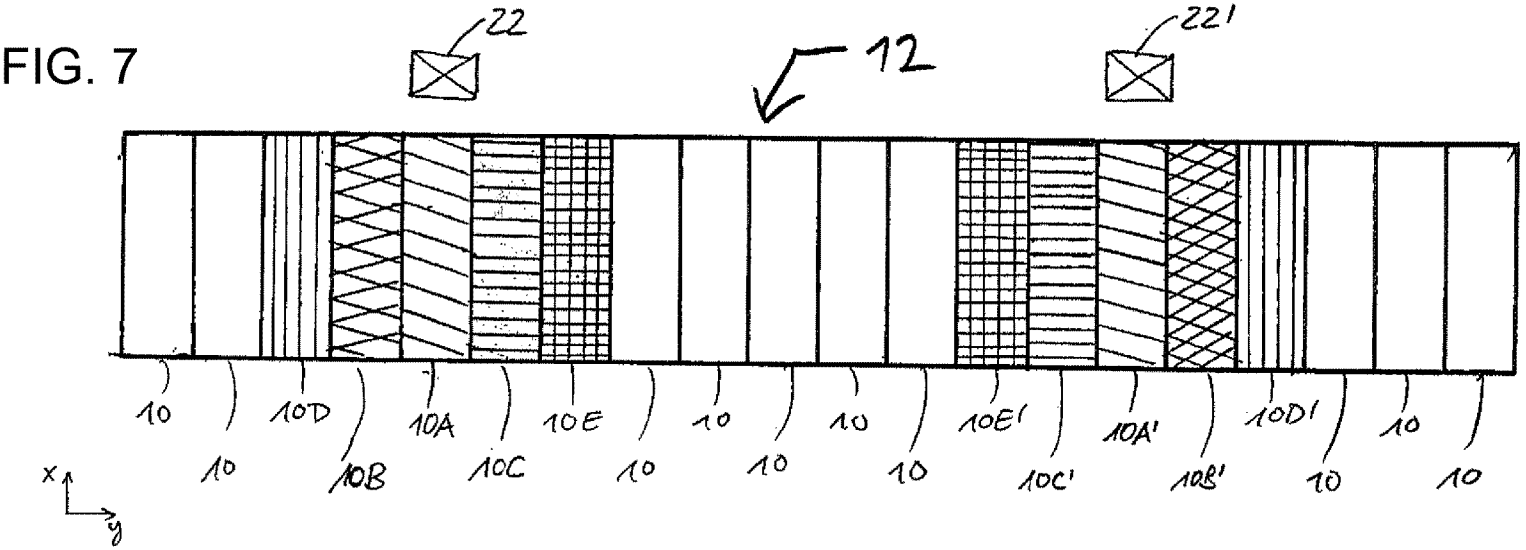

FIG. 7 shows a sixth exemplary embodiment of a cathode 12 of the electrolysis cell of the present invention which is similar to the fourth exemplary embodiment shown in FIG. 5, wherein each of the cathode blocks 10B, 10B' of kind B is, at one side, arranged adjacent to a respective cathode block 10D, 10D' of kind D. Likewise, each of the cathode blocks 100, 100' is, at one side, arranged adjacent to a respective cathode block 10E, 10E' of kind E, wherein kinds D and E are different form all other kinds with regard to at least one of the average compressive strength, the average thermal conductivity, the average specific electrical resistivity and the apparent density.

Figure 8:
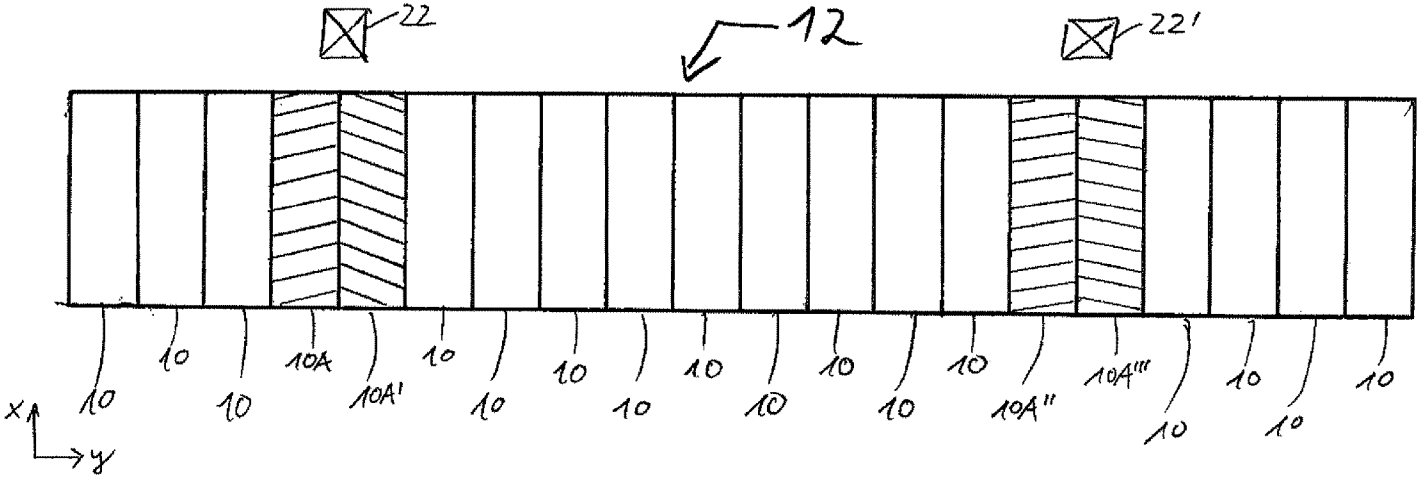
Figure 9:
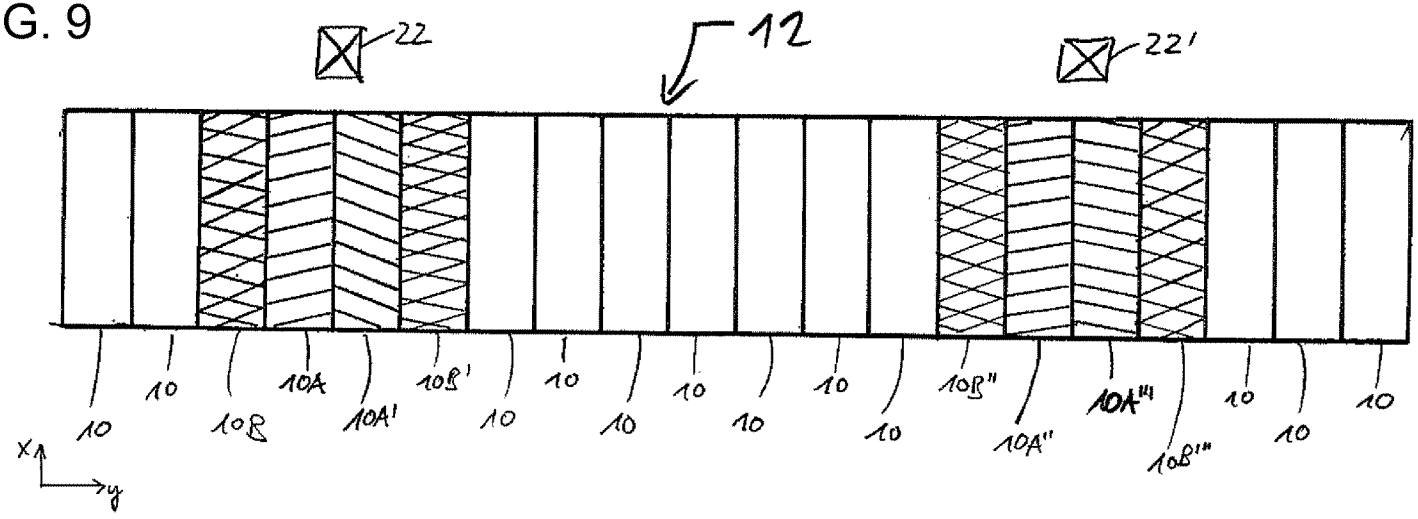
Figure 10:
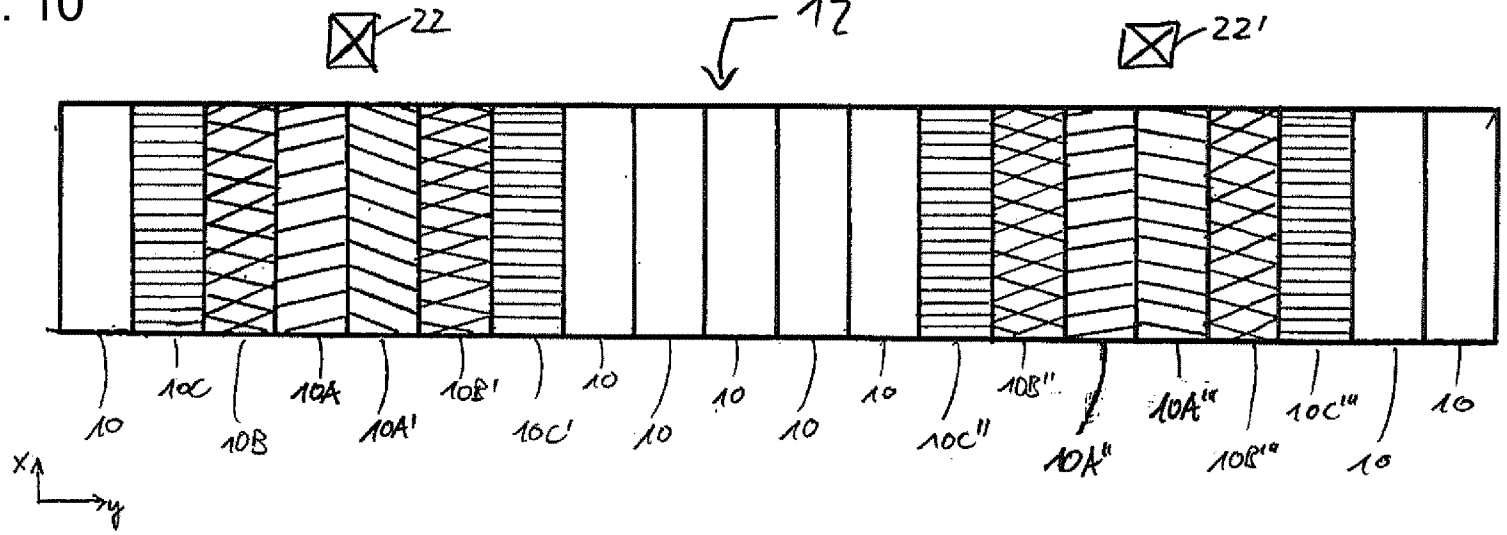
Figure 11:
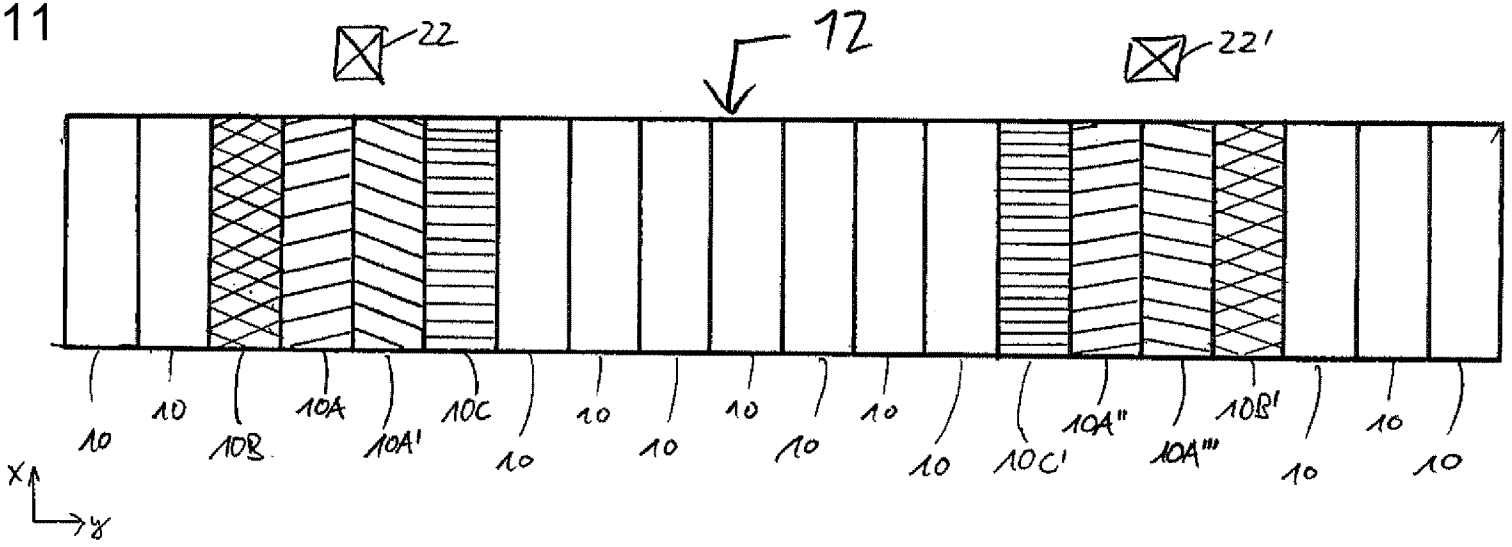
Figure 12:
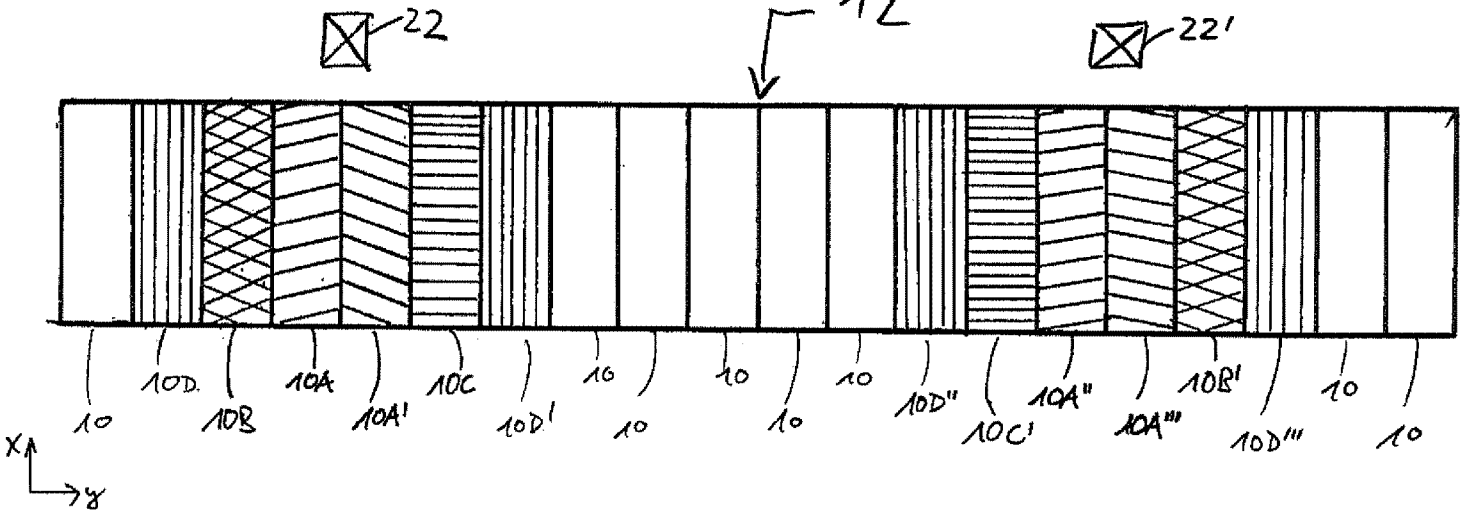
Figure 13:
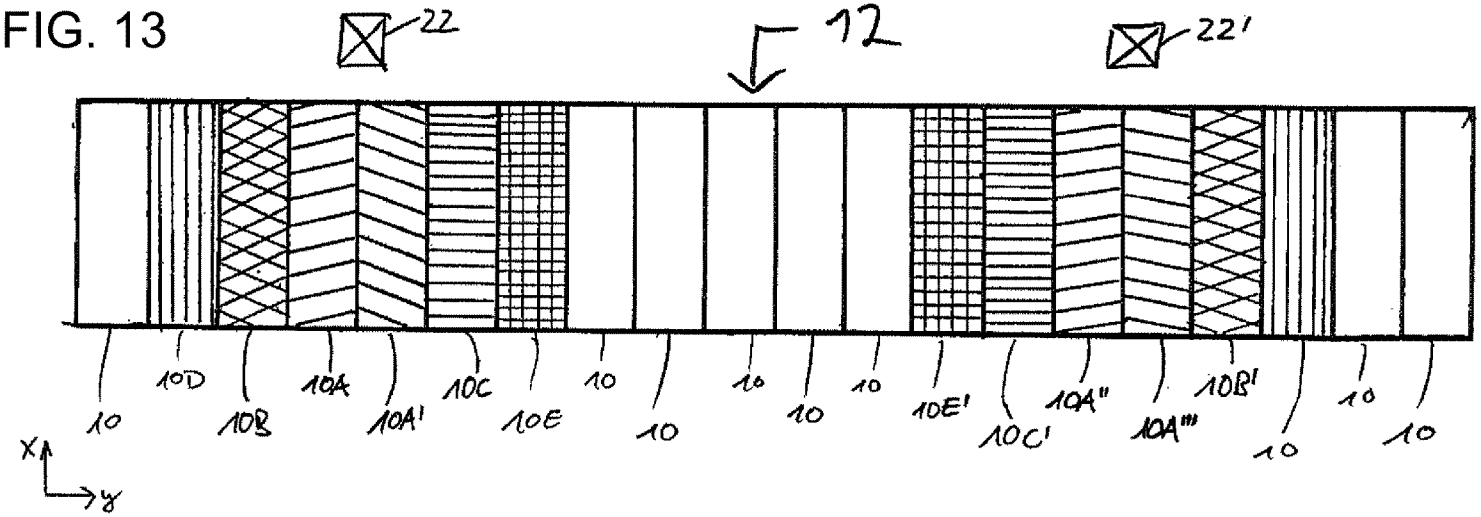

FIG. 8 shows a seventh exemplary embodiment of a cathode 12 of the electrolysis cell of the present invention. At the locations of the cathode 12 close to each current feeder 22, 22' two cathode blocks 10A, 10A' and 10A" and 10A'" of kind A adjacent to one another are arranged and are surrounded by cathode blocks 10 of another kind.

FIGS. 9 to 13 show further exemplary embodiments of a cathode 12 of the electrolysis cell of the present invention, each comprising at least two different kinds of cathode blocks.

In the following, the present invention is described by means of an example and a comparative example, which illustrate, but do not limit the present invention.

EXAMPLE

A cathode was assembled by arranging two cathode blocks of a first kind 10A, 10A', four cathode blocks of a second kind 10B, 10B', 10B", 10B'" and 14 cathode blocks of a third kind 10 as shown in FIG. 3 in an electrolysis cell as shown in FIG. 1.

The cathode blocks of the first kind had an apparent density of 1.80 g/cm$^3$, a compressive strength of 55 MPa, an specific electrical resistivity of 11 Ohm μm, a thermal conductivity of 125 W/K·m and an open porosity of 11%, whereas the cathode blocks of the second kind had an apparent density of 1.75 g/cm$^3$, a compressive strength of 48 MPa, an specific electrical resistivity of 11 Ohm μm, a thermal conductivity of 120 W/K·m and an open porosity of 13% and the cathode blocks of the third kind had an apparent density of 1.69 g/cm$^3$, a compressive strength of 35 MPa, an specific electrical resistivity of 11 Ohm μm, a thermal conductivity of 120 W/K·m and an open porosity of 16%.

The so manufactured electrolysis cell was operated for 730 days at a current flow of 360 kA.

Afterwards, the wear profile of the cathode was evaluated and it was found that the cathode surface had worn uniformly over the entire electrolysis cell cathode surface with greatly reduced wear rate compared with standard electrolysis cell built with only one kind of cathode block described below.

COMPARATIVE EXAMPLE

A cathode was assembled by arranging twenty cathode blocks of the third kind as described in the aforementioned example in an electrolysis cell as shown in FIG. 1.

The so manufactured electrolysis cell was operated as described above in the example. Afterwards, the wear profile of the cathode was evaluated and it was found that there were—in comparison to cathode of the aforementioned example—areas of higher wear which coincided with the cathode surface in the proximity of the risers. Moreover, other areas of the cathode surface showed an inconsistent degree of wear. The maximum difference in the wear rate between the most worn and the least worn surface areas was 55 mm/year.

LIST OF REFERENCE NUMERALS

10 cathode block
10A, 10A', 10A", 10A'" cathode block
10B, 10B', 10B", 10B'" cathode block
10C, 10C', 100", 10C'" cathode block
10D, 10D', 10D", 10D'" cathode block
10E, 10E' cathode block
12 cathode
14 layer of liquid aluminum
16 melt layer
18 anode
20, 20' anode block
22, 22' current feeder
24 current collector bar
x, y, z direction

The invention claimed is:

1. An electrolysis cell, comprising:

a cathode having at least two cathode blocks, wherein at least one of said at least two cathode block differs from at least one other of said cathode blocks with regard to an average compressive strength by at least 25% and an apparent density by at least 2%, wherein said at least one cathode block having a higher apparent density has a lower average open porosity than said at least one other cathode block having a lower apparent density, wherein said at least two cathode blocks consisting essentially of graphitized carbon;

a layer of liquid aluminum disposed on an upper side of said cathode;

a melt layer disposed on said layer of liquid aluminum; and an anode disposed on top of said melt layer.

2. The electrolysis cell according to claim 1, further comprising:

at least one current feeder, said at least one current feeder extending at least partially in a vertical direction and is electrically connected to said anode, and said at least one of said at least two cathode blocks differing from said at least one other of said other cathode blocks is disposed closer to said at least one current feeder than said at least one other of said cathode blocks.

3. The electrolysis cell according to claim 2, wherein said at least one of said cathode blocks of a first kind disposed closest to said at least one current feeder being positioned between two of said cathode blocks of a second kind that differs from said first kind with regard to at least one of i) the average compressive strength of said respective cathode blocks by at least 25% ii) an average thermal conductivity of said respective cathode blocks by at least 20%, iii) an average specific electrical resistivity of said respective cathode blocks by at least 20% and iv) the apparent density of said respective cathode blocks by at least 2%, wherein each of said two cathode block of said second kind is disposed adjacent to said cathode block of a third kind, wherein said third kind differs from said first kind and said second kind with regard to at least one of i) the average compressive strength of respective cathode blocks by at least 25%, ii) the average thermal conductivity of said respective cathode blocks by at least 20%, iii) the average specific electrical resistivity of said respective cathode blocks by at least 20% and iv) the apparent density of said respective cathode blocks by at least 2%.

4. The electrolysis cell according to claim 2, wherein at least two of said cathode blocks are of a first kind which are disposed adjacent to each other, at least one of said first kind is located closest to said at least one current feeder, and which are each disposed adjacent to said cathode block of a second kind that differs from said first kind with regard to at least one of i) the average compressive strength of respective cathode blocks by at least 25%, ii) an average thermal conductivity of said respective cathode blocks by at least 20%, iii) an average specific electrical resistivity of said respective cathode blocks by at least 20% and iv) the apparent density of said respective cathode blocks by at least 2%, wherein each of said at least two cathode blocks of said second kind is disposed adjacent to said cathode block of a third kind, wherein said third kind differs from said first kind and said second kind with regard to at least one of i) the average compressive strength of said respective cathode blocks by at least 25%, ii) the average thermal conductivity of said respective cathode blocks by at least 20%, iii) the average specific electrical resistivity of said respective cathode blocks by at least 20% and iv) the apparent density of said respective cathode blocks by at least 2%.

5. The electrolysis cell according to claim 2, wherein at least one of said cathode blocks being of a first kind and disposed closest to said at least one current feeder has at least one of i) the higher average compressive strength by at least 25%, ii) a higher average thermal conductivity by at least 20%, and iii) a higher average specific electrical resistivity by at least 20% than said cathode blocks of a second kind disposed more distant from said at least one current feeder.

6. The electrolysis cell according to claim 2, wherein at least one of said cathode blocks being of a first kind and disposed closest to said at least one current feeder has at least one of i) a lower average compressive strength by at least 25%, ii) a lower average thermal conductivity by at least 20%, and iii) a lower average specific electrical resistivity by at least 20% than said cathode blocks of a second kind that are disposed more distant from said at least one current feeder.

7. The electrolysis cell according to claim 1, wherein said cathode contains at least two different kinds of said cathode blocks, said cathode blocks of each kind further differ from those of any other kind with regard to average specific electrical resistivity by at least 20%, whereas all of said cathode blocks of one kind differ from each other with regard to the average compressive strength by less than 15%, with regard to average thermal conductivity by less than 10%, with regard to the average specific electrical resistivity by less than 12% and with regard to the apparent density by less than 1.5%.

8. The electrolysis cell according to claim 7, wherein said cathode contains three different kinds of said cathode blocks, said cathode blocks of each kind differ from those of said other two kinds with regard to at least one of i) the average compressive strength by at least 25%, ii) the average specific electrical resistivity by at least 20% and iii) the apparent density by at least 2%.

9. The electrolysis cell according to claim 7, wherein said cathode contains three different kinds of said cathode blocks, said cathode blocks of each kind differ from those of said other two kinds with regard to at least one of i) the average compressive strength by at least 35%, ii) the average thermal conductivity by at least 50%, iii) the average specific electrical resistivity by at least 30%, and iv) the apparent density by at least 4%.

10. The electrolysis cell according claim 1, wherein a difference between the average compressive strength of said at least one cathode block differing from said at least one other of said other cathode blocks and the average compressive strength of said at least one other cathode block is at least 25% of a lowest of average compressive strengths.

11. The electrolysis cell according to claim 10, wherein said cathode contains at least three different kinds of said cathode blocks, wherein average compressive strengths of all of said cathode blocks of one kind differ from each other by less than 15% and the average compressive strengths of all said cathode blocks of one kind differ from the average compressive strengths of all said cathode blocks of all other kinds by at least 25% of a lowest of the average compressive strengths.

12. The electrolysis cell according to claim 1, wherein a difference between an average thermal conductivity of said at least one of said cathode blocks differing from at least one of said other cathode blocks and the average thermal conductivity of said at least one of said other cathode blocks is at least 20% of a lowest of average thermal conductivities.

13. The electrolysis cell according to claim 12, wherein said cathode contains at least three different kinds of said cathode blocks, wherein average thermal conductivities of all of said cathode blocks of one kind differ from each other by less than 10% and the average thermal conductivities of all of said cathode blocks of one kind differ from the average thermal conductivities of all said cathode blocks of all other kinds by at least 20% of a lowest of the average thermal conductivities.

14. The electrolysis cell according to claim 1, wherein at least one of said cathode blocks has an average specific electrical resistivity between 7 and 40 Ohm μm.

15. The electrolysis cell according to claim 1, wherein a difference between average specific electrical resistivity of said at least one cathode block differing from at least one of said other cathode block and the average specific electrical resistivity of said at least one of said other cathode blocks is at least 20% of a lowest of average specific electrical resistivities.

16. The electrolysis cell according to claim 15, wherein said cathode contains at least three different kinds of said cathode blocks, wherein average specific electrical resistivities of all of said cathode blocks of one kind differ from each other by less than 12% and the average specific electrical resistivities of all of said cathode blocks of one kind differ from the average specific electrical resistivities of all of said cathode blocks of all other kinds by at least 20% of a lowest of the average specific electrical resistivities.

17. The electrolysis cell according to claim 1, wherein a difference between the apparent density of said at least one cathode block differing from said at least other cathode block and the apparent density of said at least one other cathode block is at least 2% of a lowest of the apparent densities.

18. The electrolysis cell according to claim 17, wherein said cathode contains at least three different kinds of said cathode blocks, wherein apparent densities of all of said cathode blocks of one kind differ from each other by less than 1.5% and the apparent densities of all of said cathode blocks of one kind differ from the apparent densities of all of said cathode blocks of all other kinds at least 2% of a lowest of the apparent densities.

19. The electrolysis cell according to claim 1, wherein said cathode contains at least two different kinds of said cathode blocks, wherein said cathode blocks of each kind differ from those of any other kind with regard to at least one of i) the average compressive strength by at least 70%, ii) average specific electrical resistivity by at least 100% and iii) the apparent density by at least 8%, whereas all of said cathode blocks of one kind differ from each other with regard to the average compressive strength by less than 4%, with regard to the average specific electrical resistivity by less than 4% and with regard to the apparent density by less than 0.4%.

20. The electrolysis cell according to claim 1, wherein said cathode contains at least two different kinds of said cathode blocks, wherein said cathode blocks of each kind differ from those of any other kind with regard to at least one of i) the average compressive strength by at least 50%, ii) average specific electrical resistivity by at least 50% and iii) the apparent density by at least 6%, whereas all of said cathode blocks of one kind differ from each other with regard to the average compressive strength by less than 8%, with regard to the average specific electrical resistivity by less than 6% and with regard to the apparent density by less than 0.8%.

21. The electrolysis cell according to claim 1, wherein at least one of said at least two cathode block differs from at least one other of said cathode blocks with regard to at least one of an average thermal conductivity or an average specific electrical resistivity.

22. The electrolysis cell according to claim 1, wherein:

said cathode contains at least two different kinds of said cathode blocks;

a difference between an average open porosity of at least one of said cathode blocks differing from at least one other of said cathode blocks and the average open porosity of said at least one other cathode block is at least 15% of a lowest of average open porosities.

23. The electrolysis cell according to claim 1, wherein:

said cathode contains at least two different kinds of said cathode blocks; and a difference between an average open porosity of at least one of said cathode blocks differing from at least one other of said cathode blocks, and the average open porosity of said at least one other cathode block is at least 20% of a lowest of average open porosities.

24. The electrolysis cell according to claim 1, wherein:

said cathode contains at least two different kinds of said cathode blocks; and a difference between an average open porosity of at least one of said cathode blocks differing from at least one other of said cathode block and the average open porosity of said at least one other cathode block is at least 30% of a lowest of average open porosities.

25. The electrolysis cell according to claim 1, wherein:

said cathode contains at least two different kinds of said cathode blocks; and a difference between an average open porosity of at least one of said cathode blocks differing from at least one other of said cathode blocks and the average open porosity of said at least one other cathode block is at least 40% of a lowest of average open porosities.

* * * * *